US005906272A

United States Patent [19]

Kurek

[11] Patent Number: 5,906,272

[45] Date of Patent: May 25, 1999

[54] ELECTRICAL TOGGLE-TYPE SWITCH

[75] Inventor: Stephen R. Kurek, Rego Park, N.Y.

[73] Assignee: Leviton Manufacturing Co., Inc., Little Neck, N.Y.

[21] Appl. No.: 08/919,684

[22] Filed: Aug. 28, 1997

[51] Int. Cl.[6] ..... H01H 21/84

[52] U.S. Cl. ..... 200/559; 200/339

[58] Field of Search ..... 200/556, 557, 200/558, 559, 553, 339, 437, 551

[56] References Cited

U.S. PATENT DOCUMENTS 3,852,552 12/1974 Kimijima et al. ..... 200/557
5,382,768 1/1995 Kurek et al. ..... 200/559 X

*Primary Examiner*—Renee S. Luebke
*Attorney, Agent, or Firm*—Paul J. Sutton

[57] ABSTRACT

A toggle-type switch employing a cam controlled toggle lever to move or permit to move resilient arms on which are located movable contacts into engagement with fixed contacts. The number of resilient arms and movable contacts and the number of fixed contacts is selected to make and break tie desired number of circuits. The manner in which the circuits are closed or opened depends upon the shape of the cam surface and the cam is spring loaded to hold the toggle in a selected position on a momentary or maintained basis. A slider cooperates with the toggle lever to move selected movable contacts into contact with fixed contacts or allows movable contacts to move out of engagement with other fixed contacts.

14 Claims, 12 Drawing Sheets

ELECTRICAL TOGGLE-TYPE SWITCH

BACKGROUND OF THE INVENTION

1. Field of the Invention

The invention is directed to electrical switches for home and commercial use and more particularly to switches of the toggle-type operated by a toggle handle.

2. Description of the Prior Art

In the usual toggle-type switch the toggle handle is supported for pivotal movement with respect to the housing and moved by the switch operator. The lower end of the toggle handle is spring loaded to take one of two over-center positions. By providing suitable contacts, such over-center mechanisms give positive on/off operation as well as single pole, double throw and double pole, double throw switch operations. Momentary switches are more difficult to make because there is no positive feel that the switch has been closed and center-off switches are not possible at all. Additionally, complex spring arrangements are required to position the movable central pole on both single and double pole switches. Also, the over-center spring action causes the poles to snap from one set position to the other making the switch reasonably noisy.

SUMMARY OF THE INVENTION

The instant invention overcomes the difficulties noted above with respect to the prior art by providing a basic switch mechanism which can, with only minor changes, be made as a simple on/off switch, a single pole, double throw or double pole, double throw switch, a momentary on/off switch, a single or double pole, double throw momentary switch with center off, a single pole, double throw or double pole, double throw position maintained switch with center off. The functioning of the switch depends upon the cam that is placed at the switch bottom and spring biased against the cam follower end of the toggle handle. The spring loading retains the toggle handle in its pivotal position on the switch body and allows the cam to be displaced and recover in response to the movement of the toggle handle. A slider, through which the toggle handle passes is positioned to operate the various contacts or allow displaced contacts to return to initial positions in response to the toggle handle position based upon the cam surface. Spring arm movable contacts are biased to engage certain fixed contacts eliminating the need for separate springs. The body can be modified for each particular switch based upon the type and the number of contacts to be employed. It is an object of the instant invention to prove an improved toggle-type electrical switch.

It is another object of the instant invention to provide an improved toggle-type electrical switch which can be configured by changing an internal cam.

It is yet another object of the instant invention to provide an improved toggle-type switch which can be employed as a maintained or momentary switch.

It is still another object of the instant invention to provide an improved toggle-type which can be employed as a maintained or momentary switch with a center off position.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 4:
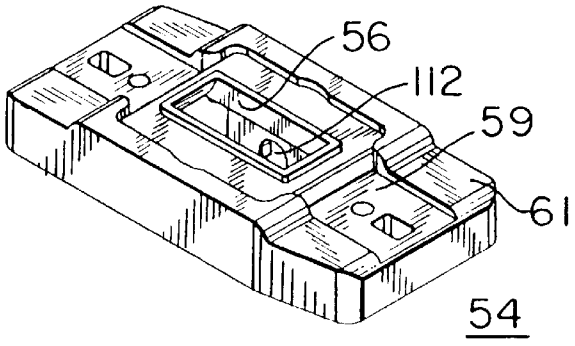
FIG. 4 is a top perspective view of the cap of the switch of FIG. 1.
Figure 21:
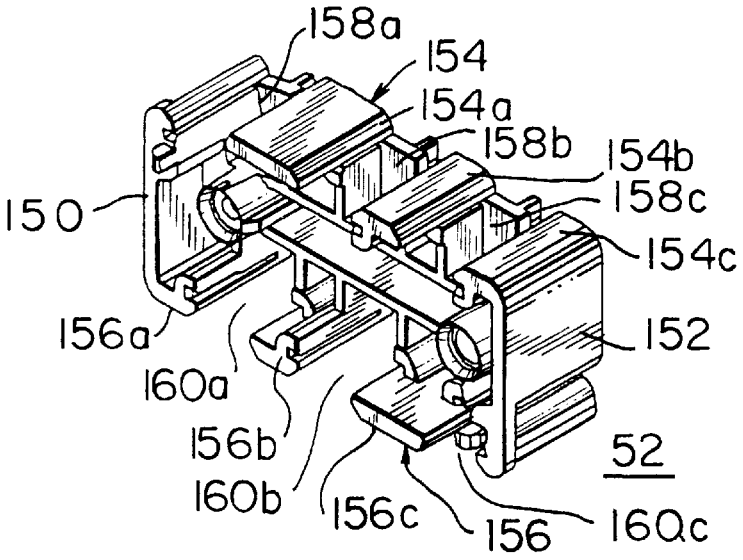
FIG. 21 is a perspective view of the switch housing of FIG. 19 on its side.
Figure 22:
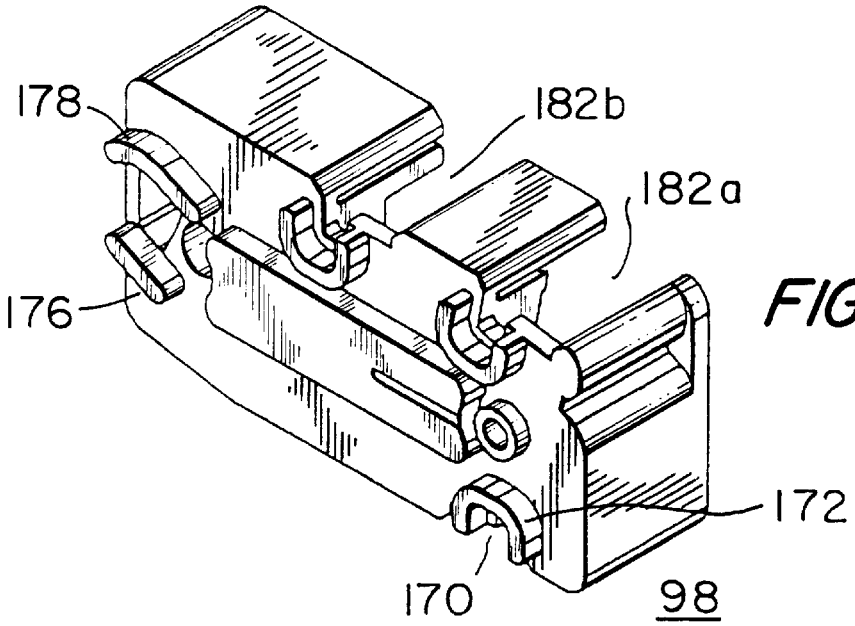
FIG. 22 is a perspective view of a further switch housing on its side.
Figure 23:
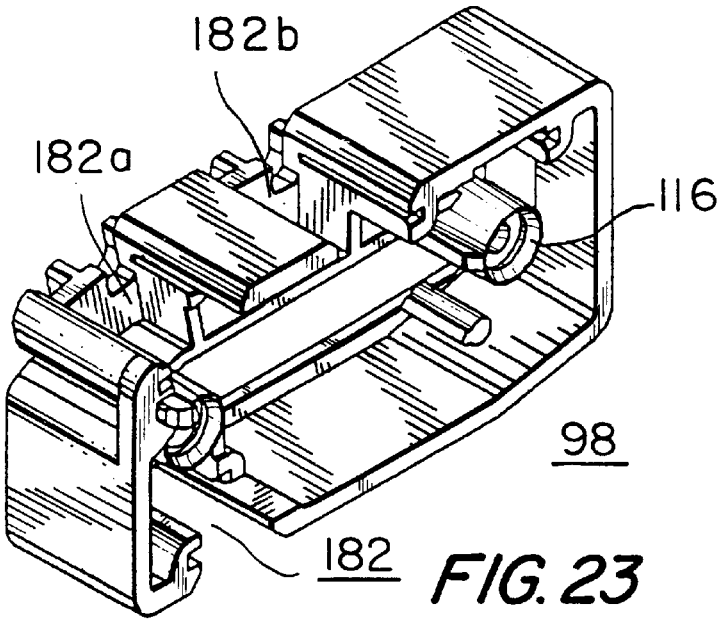
FIG. 23 is a perspective view of another switch housing on its side.
Figure 24:
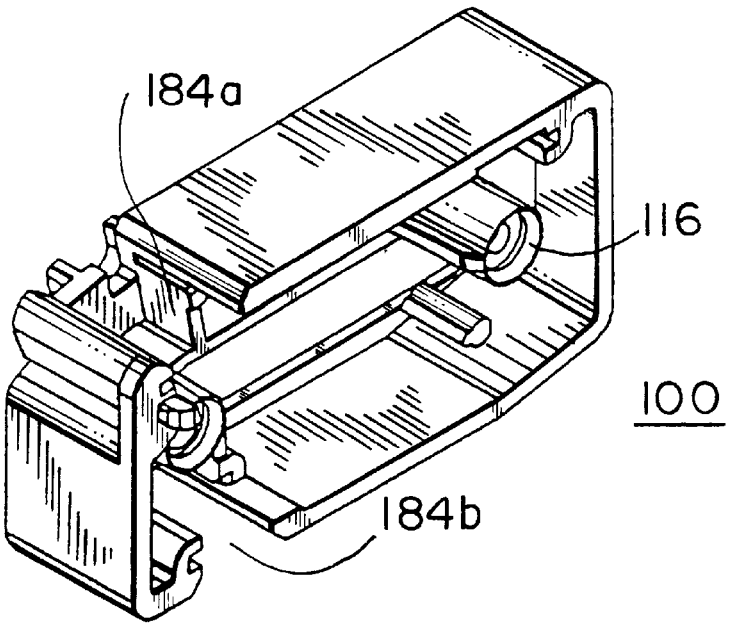
FIG. 24 is a perspective view of still another switch housing on its side.
Figure 29:
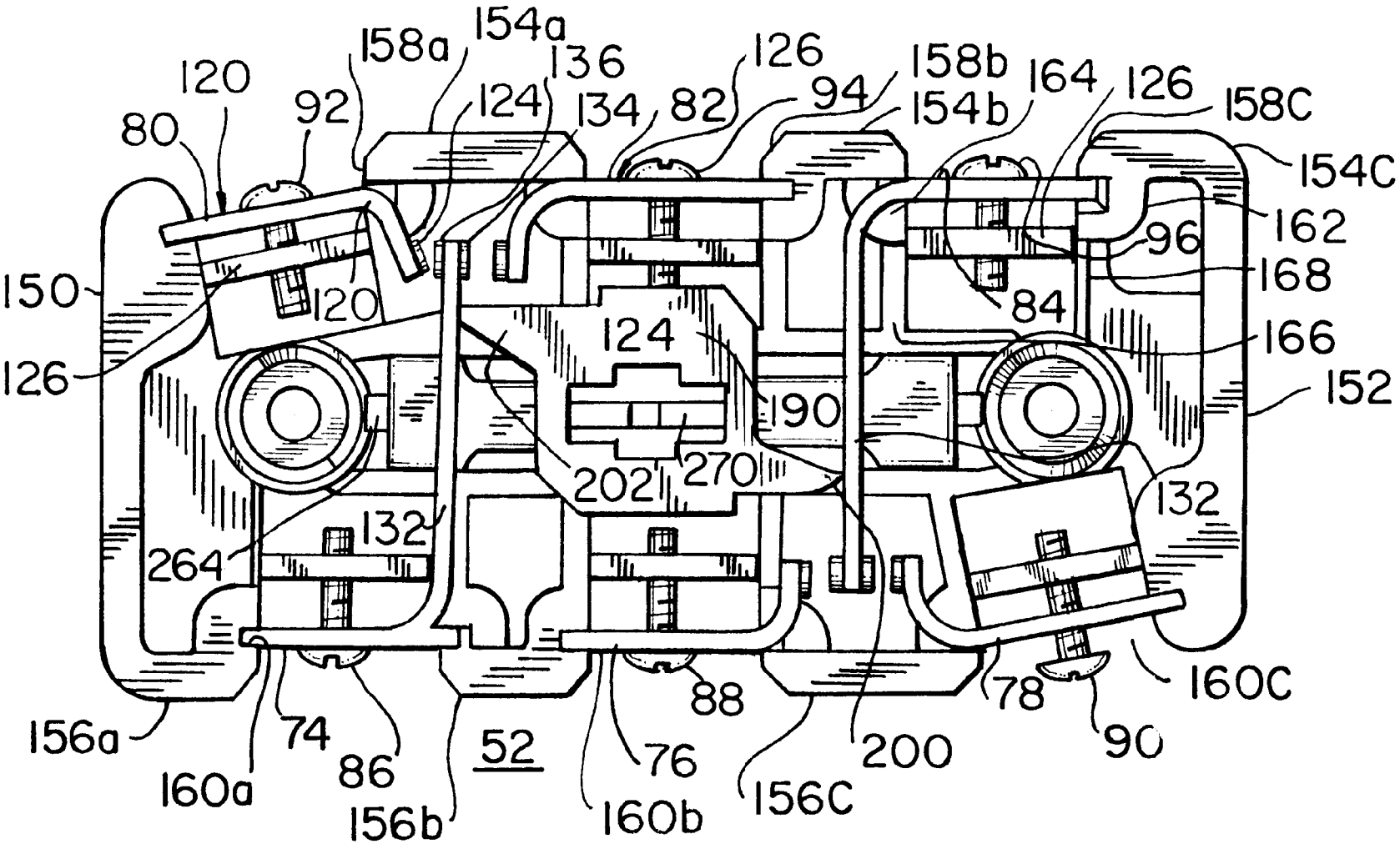
FIG. 29 is a top plan view of the switch of FIG. 1 with the cap removed to show the components of the switch.

Turning now to FIGS. 1 to 29 there is shown a toggle-type switch 50 constructed in accordance with the concepts of the invention. The toggle-type switch 50 has a base 52 which is substantially hollow, a cap 54 which substantially covers the open face of base 52, and a toggle lever 58 of toggle means 57 extending through an aperture 56 in cap 54 and a strap 60 also having an aperture 62 through which toggle lever 58 extends. Strap 60, which is seated in a recess 59 (see FIG. 4) in the top surface 61 of cap 54, has slots 64 through which fasteners 66 extend to permit the switch to be mounted in and to a ganged box or the like (not shown). The apertures 68 receive assembly rivets 70 while the apertures 72 are threaded to receive the mounting screws of a face plate (not shown). Three contact plates 74, 76 and 78 each receive a terminal screw 86, 88 and 90 for the attachment of conductors (not shown) as will be described below. As best seen in FIGS. 21 and 29, the base 52 for a double-pole, double throw switch 50 has provision for six contact plates 74, 76, 78, 80, 82 and 84, each with a terminal screw 86, 88, 90, 92, 94 and 96, respectively. Base 98 for a single pole, double throw switch is shown in FIGS. 22 and 23 while a single pole, single throw or on/off switch base 100 is shown in FIG. 24.

Figure 5:
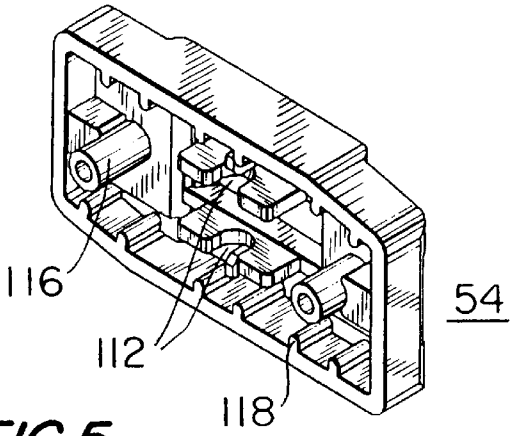
FIG. 5 is a bottom perspective view of the cap of FIG. 4.
Figure 6:
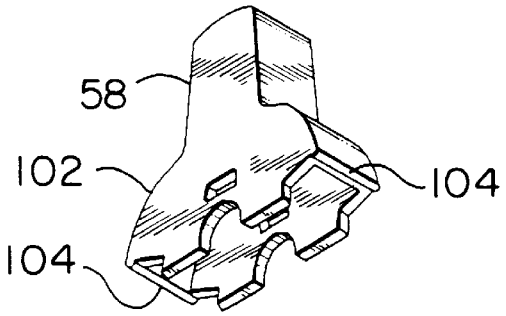
FIG. 6 is a perspective view of the toggle handle of the switch of FIG. 1.
Figure 7:
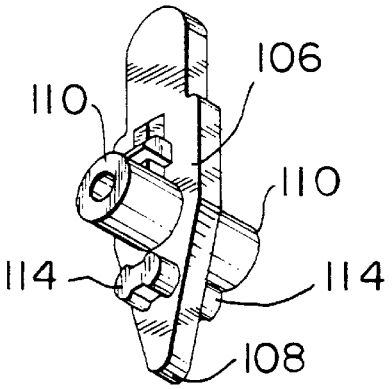
FIG. 7 is a perspective view of the toggle handle body and cam follower end of the switch of FIG. 1.
Figure 8:
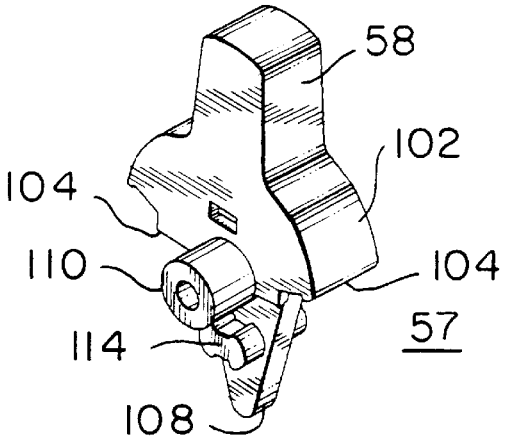
FIG. 8 is a perspective view of the assembled toggle handle of FIG. 6 and the toggle handle body of FIG. 7.
Figure 12:
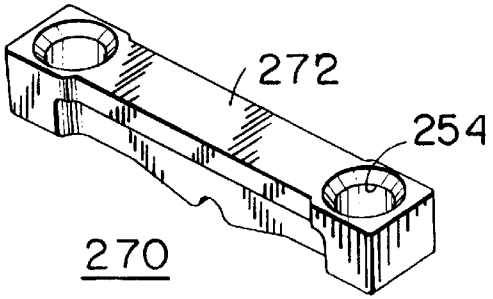
FIG. 12 is a bottom perspective view of the cam of FIG. 11.

The toggle lever 58, as shown in FIG. 6, includes a skirt 102 which prevents contact with any of the switch mechanisms within base 52 and stop surfaces 104 which limit rotation of the toggle lever 58 about its pivot. The toggle lever 58 is coupled to toggle lever body 106 at its upper end and toggle lever body 106 terminates in a cam follower 108 at its lower end (see FIG. 7). Pivot pins 110 extend outwardly from the toggle lever body 106 for engagement with the recesses 112 in the underside of cap 54 as shown in FIG. 5. The pivot pins 110 will be free to rotate about the recesses and held in place by the engagement of the cam follower 108 with the spring loaded cam to be discussed below. Intermediate the pivot pins 110 and the cam follower 108 are two slider actuators 114 which position the slider as set forth below. The complete toggle means 57 is shown in FIG. 8. Although the toggle means 57 is fabricated from two parts it can be made as a single unit. The underside of cap 54 as shown in FIG. 5 also includes two hollow columns 116 through which the assembly rivets 70 pass and a number of ribs 118 which hold the contact plates in place when the cap 54 is assembled to base 52.

Figure 26:
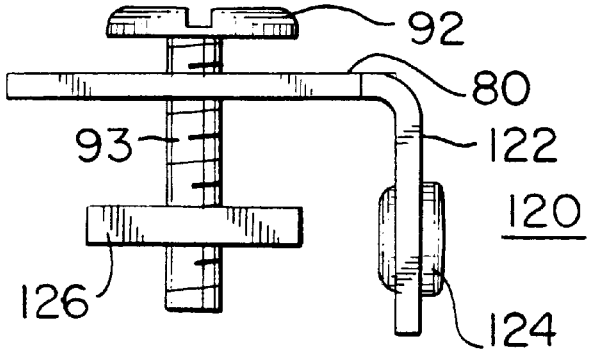
FIG. 26 is a top plan view of the fixed contact of FIG. 25.
Figure 25:
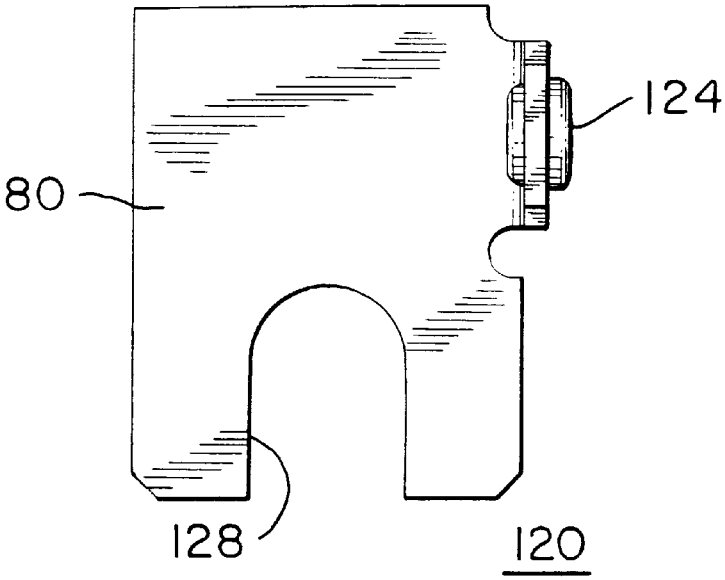
FIG. 25 is a front elevational view of a fixed contact of the switch of FIG. 1.
Figure 28:
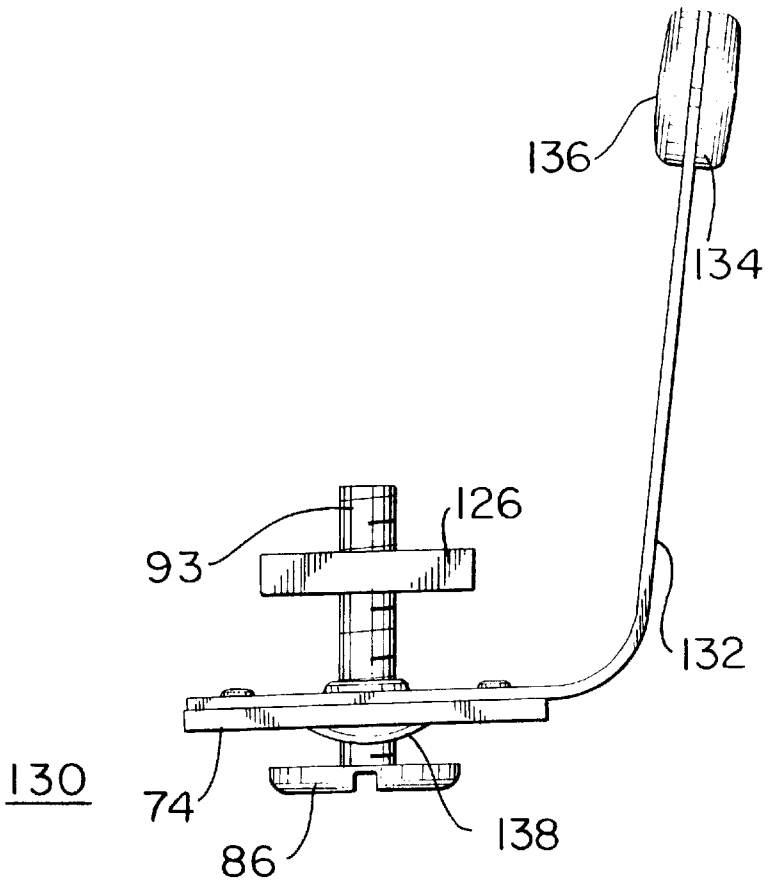
FIG. 28 is a top plan view of the movable contact arm and movable contact of FIG. 27.
Figure 27:
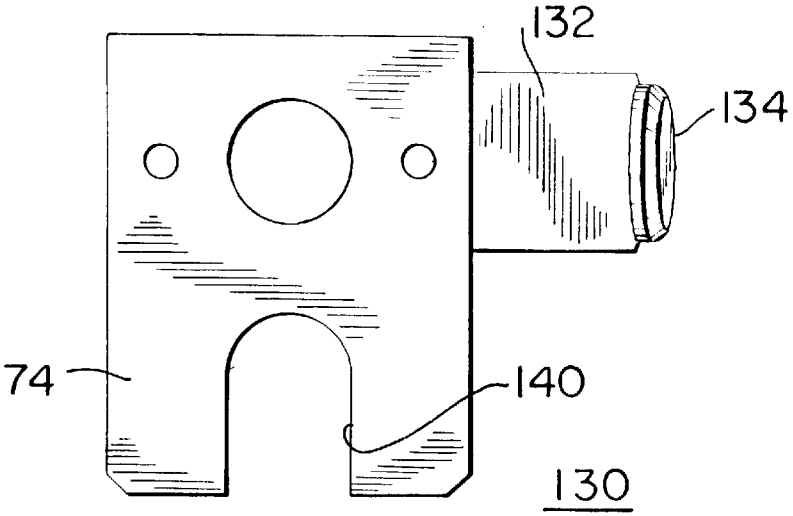
FIG. 27 is a front elevational view of a movable contact arm and movable contact of the switch of FIG. 1.

FIGS. 25 and 26 show the contact support 120 in a generally L-shape and having a first portion contact plate 80 and a second portion fixed contact support 122 on which is placed fixed contact 124. The contact 124 can be made of silver, silver alloy or a silver plated base member and can be brazed, welded or mechanically joined as by swaging or staking. A gripping plate 126 is threadedly mounted upon the threaded portion 93 of terminal screw 92 which passes trough an aperture 128 in contact plate 80. The contact support 120 can be fabricated with fixed contact support 122 along the right edge of contact plate 80 or the left edge of contact plate 80 depending upon the placement of the contact support 120 within base 52 or the other bases 98 and 100. The mirror image contact support 120' is shown in FIG. 29. The striped end of a conductor (not shown) can be bent into a generally U-shape and placed about the threaded portion 93 of terminal screw 92 under the screw head of the terminal screw 92 which is tightened to clamp such conductor between the head of the terminal screw 92 and the contact plate 80. The gripping plate 126 is prevented from rotating which causes the gripping plate 126 to advance so that it engages the rear surface of contact plate 80 as the terminal screw 92 is turned. As will be disclosed below, the bared ends of conductors can be inserted from the bottom of base 52 between the gripping plate 126 and the rear surface of contact plate 80.

The construction of the contact support 130 is similar to contact support 120 in many ways. Contact plate 74 has an aperture 140 through which the threaded portion 93 of terminal screw 86 passes and a gripping plate 126 is threadedly mounted upon threaded portion 93 to be advanced as terminal screw 86 is rotated. A resilient arm 132 is riveted as with rivet 138 to the contact plate 74. As will be described below, the resilient arm 132 is biased so as to make an angle of less than 90° with respect to the plane of contact plate 74 to contact a fixed contact such as 124 when not acted on by the slider as described below. At the free end of resilient arm 132 are two contacts 134, 136 of silver, silver alloy or silver plated base metal for a use in a double throw switch. If the contact support is only to be used in a single throw switch one of the contacts 134, 136 may be omitted. The bared end of a conductor (not shown) is attached to contact support 130 in the same manner as to contact support 120.

Turning now to FIGS. 19 to 21 and 29 the manner of mounting the contact supports 120 and 130 and the manner of attaching bared conductors to the contacts are shown. Base 52 has two end walls 150 and 152 and two side walls 154 and 156. The side walls 154 and 156 are described by a series of segments based upon the number of contact supports 120 and 130 to be employed. End wall 150 and segment 154*a* define a first slot 158*a*, segments 154*a* and 154*b* define a second slot 158*b* and segments 154*b* and 154*c* define slot 158*c*. Segments 156*a* and 156*b* define a slot 160*a*, segments 156*b* and 156*c* define a slot 160*b* while segment 156*c* and end wall 152 define slot 160*c*. Adjacent each of the slots is a generally L-shaped projection which combined with the wall segments provides a slot for receipt of the ends of the contact plates. For example, slot 158*c* has an L-shaped projection 162 spaced from the rear wall of segment 154*c* and an L-shaped projection 164 spaced from the rear wall of segment 154*b*. The ends of contact plate 84 of contact support 120 can be placed in the slots formed by L-shaped projections 162 and 164 and be retained in base 52. The gripping plate 126 is prevented from rotating by its ends engaging ribs 166 and 168. The gripping plate 126 is movable between the ribs 166 and 168 but cannot rotate and is moved by the terminal screw 96.

The bottom of base 52 is provided with a slot for each of the slots in the side wall and one base bottom slot communicates with an associated side wall slot. For example, base bottom slot 170*c* communicates with side wall slot 160*c*. The bared end of an insulated conductor (not shown) can be introduced through base bottom slot 170*c* and into wall slot 160*c* between the back surface of contact plate 78 and its associated gripping plate 126. The tightening of terminal screw 90 will clamp the bared end of the conductor therebetween. Each base bottom slot 170 is surrounded on tree sides with an insulation barrier 172 to prevent unwanted contact between adjacent conductors. A grounding lug 174 may be attached to one of the rivets 70 and is positioned between insulation barriers 176, 178. A grounding screw 180 is threadedly received in ground lug 174 (see FIG. 3).

Base 98 of FIGS. 22 and 23 has three slots 182*a*, 182*b* and 182*c* to receive contact supports 120, 130 and 120, respectively. This will permit the resulting switch to act as a single pole, double throw switch. Base bottom slots 170 provide access to the slots 182*a*, 182*b* and 182*c* and insulation barriers 172 isolate the respective conductors entering slots 170. Insulation barriers 176 and 178 isolate the ground lug (not shown). Base 100, for a single pole, single throw or simple on/off switch has two slots 184*a* and 184*b* to receive contact supports 120 and 130, respectively. Base bottom slots are also present as are the various insulation barriers.

Figure 10:
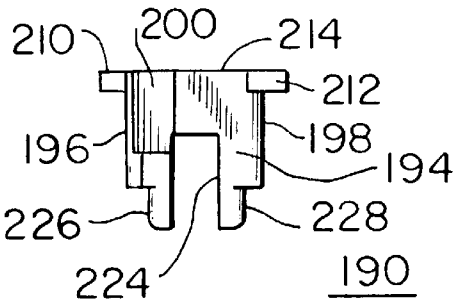
FIG. 10 is an end, elevational view of the slider of FIG. 9.
Figure 9:
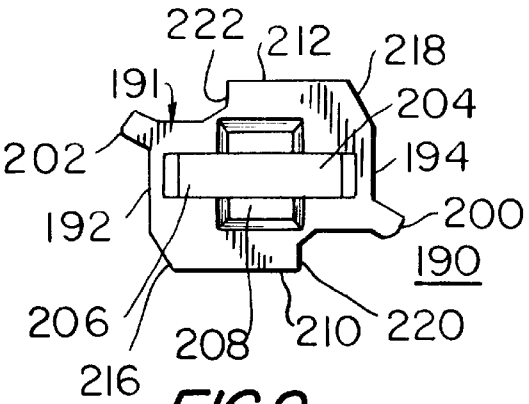
FIG. 9 is a top plan view of the slider of the switch of FIG. 1.

Turning now to FIGS. 9 and 10, the slider 190 is shown. The slider 190 has a generally rectangular body 191 with end walls 192, 194 and side walls 196, 198. A nose 200 extends from the junction of end wall 194 and side wall 196 while a nose 202 extends from the junction of end wall 192 and side wall 198. The noses 200 and 202 individually engage the resilient arms 132 and move them to engage their movable contacts 136 with the fixed contacts 124 depending upon the direction of movement of slider 190. A generally cruciform opening 204 is positioned in the center of slider 190. The longer longitudinal slot 206 is arranged to receive toggle lever body 106 therein. The shorter transverse slots 208 receive the two slider actuators 114 which act on the walls of slider 191 which define slot 208 to move the slider 191 in accordance with the movement of toggle lever 58. Extension 210 of side wall 196 and 212 of side wall 198 extend the top surface 214 of slider 190 which receives thereon a portion of pivot pins 110 as the toggle lever 58 is moved to support the toggle lever 106 and retain the pivot pins 110 in recesses 112 of cap 54. One of the noses 200 and 202 is engaged by one of the stop surfaces 104 of toggle lever 58 to limit the rotation of toggle lever 58 and provide positive stops. The removal of corners 216, 218 prevents contact with resilient arms 132 by anything other than noses 200 and 202. Extension 210 terminates at 220 short of end wall 194 and extension 212 terminates at 222 short of end wall 192 to prevent contact with a fixed contact support 120 which could prevent proper contact of the noses 200 and 202 with the resilient contact arms 132. The end walls 192, 194 are slotted as at 224 and the side walls 196, 198 are thinned as at 226, 228, respectively, for reasons that will be set forth below.

Figure 14:
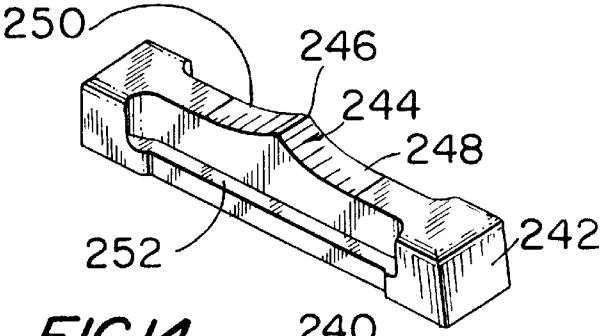
FIG. 14 is a top perspective view of another cam which may be employed in the switch of FIG. 1.
Figure 11:
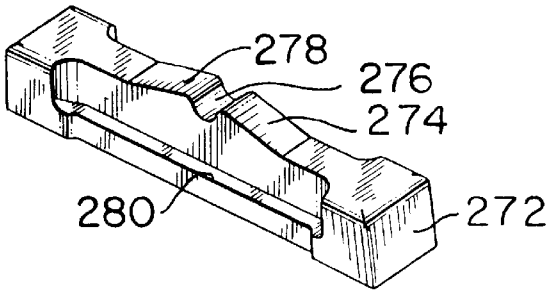
FIG. 11 is a top perspective view of a first cam which may be employed in the switch of FIG. 1.
Figure 13:
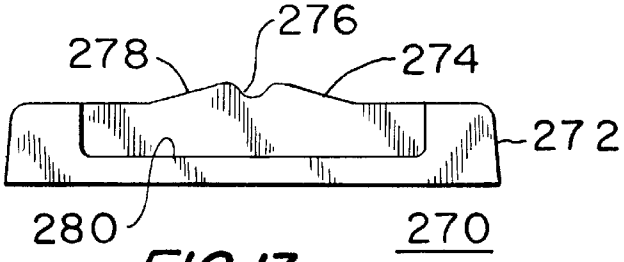
FIG. 13 is a side elevational view of the cam of FIG. 11.
Figure 18:
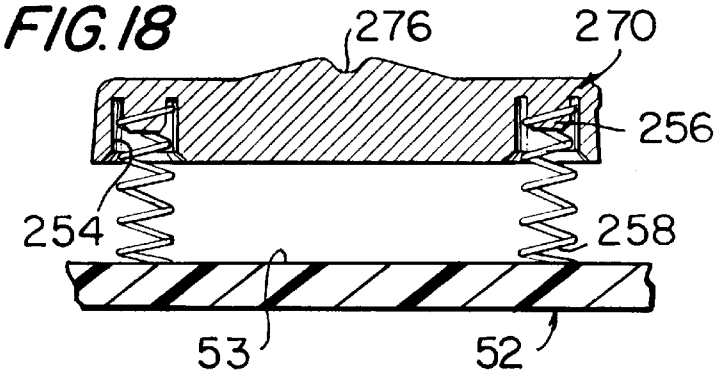
FIG. 18 is a side elevational view, in section, showing the bias springs for the cams of FIGS. 11 to 17.
Figure 15:
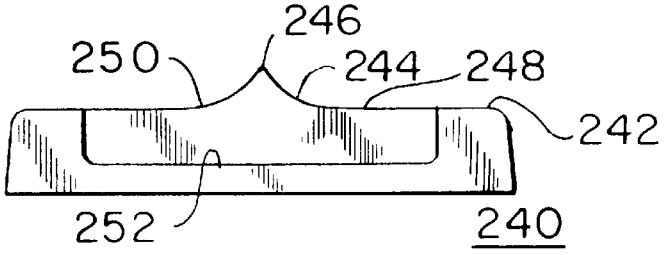
FIG. 15 is a side elevational view of the cam of FIG. 14.

As set forth above, the cam members determine the way in which the switch will operate. As shown in FIGS. 14 and 15 the cam 240 is arranged for a two position switch, that is a simple on/off switch or a single or double pole double throw switch. Cam 240 has a body 242 with a cam surface 244 on its upper surface. Cam surface 244 has a high point 246 with tapered shoulders 248, 250, one to each side of high point 246. As shown in FIG. 18, the lower surface of cam 240 is similar to the lower surface of cam 270 and is bored to provide spring recesses 254 with a central hubs 256 about which the springs 258 are placed. The other ends of the springs 258 rest against the interior surface or floor 53 of base 52. The springs 258 tend to bias the cam 240 away from floor 53 and into intimate contact with the cam follower 108 of toggle means 57. As the toggle lever 58 is moved to the left in FIG. 2 the cam follower 108 moves along the tapered shoulder 250 and depresses cam 240 against springs 258. When the cam follower 108 passes over high point 246 and follows tapered shoulder 248 the springs 258 expand to force the cam follower 108 further along tapered shoulder 248 to prevent any retrograde movement back towards the high point 246. This establishes one of the two stable settings of the switch toggle lever 58. In the same way the movement of toggle lever 58 to the right in FIG. 2 causes cam follower 108 to move along tapered shoulder 248, over high point 246 to tapered shoulder 250. The second stable setting of the toggle lever 58 is set by the engagement of cam follower 108 with tapered surface 250.

Cam 240 body 242 is thinned from its top to provide two rails 252 (only one is visible in FIGS. 14 and 15) upon which the slider 190 moves. The thinned portions 226, 228 of slider 190 ride upon the rails 252 and the slots 224 permit the slider 190 to pass over the surface of cam 240 without contact. The cam 240 is prevented from moving laterally with respect to floor 53 of base 52 by side rails 260, 262 and the ribs 264 on the columns 116 (see FIG. 19).

The cam 270 of FIGS. 11, 12, 13 and 18 is essentially the same as cam 240 except that the high point 246 is replaced by a valley 276 from which lead tapered shoulders 274, 278. Body 272 contains rails 280. This provides a center off position where none of the contacts are engaged. Thus, there is a first contact closed position, an off position and a second contact closed position. This cam can be used with either a single or double pole switch.

Figure 1:
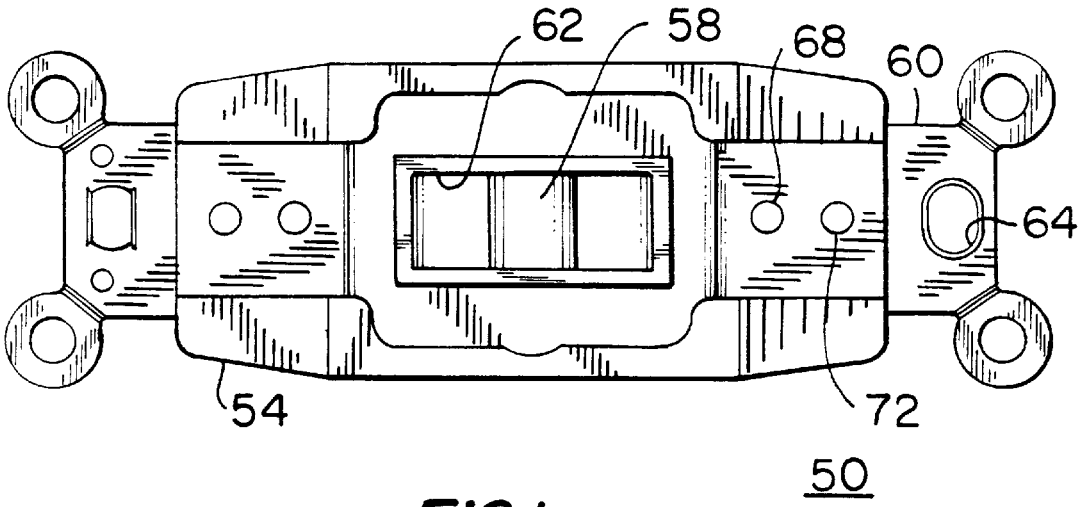
FIG. 1 is a top plan view of a toggle-type switch according to the concepts of the instant invention.
Figure 2:
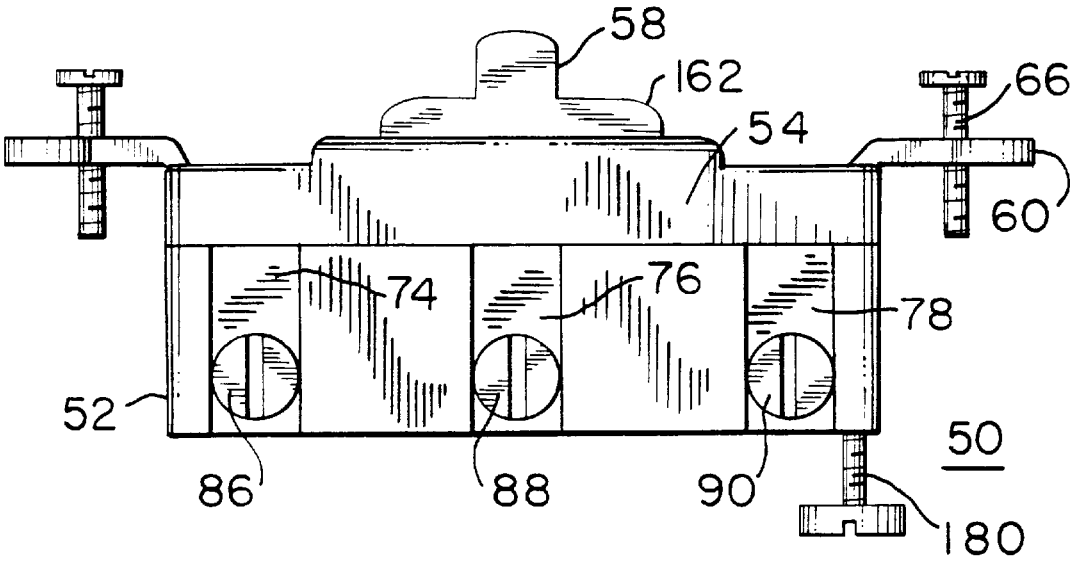
FIG. 2 is a side elevational view of the switch of FIG. 1.
Figure 3:
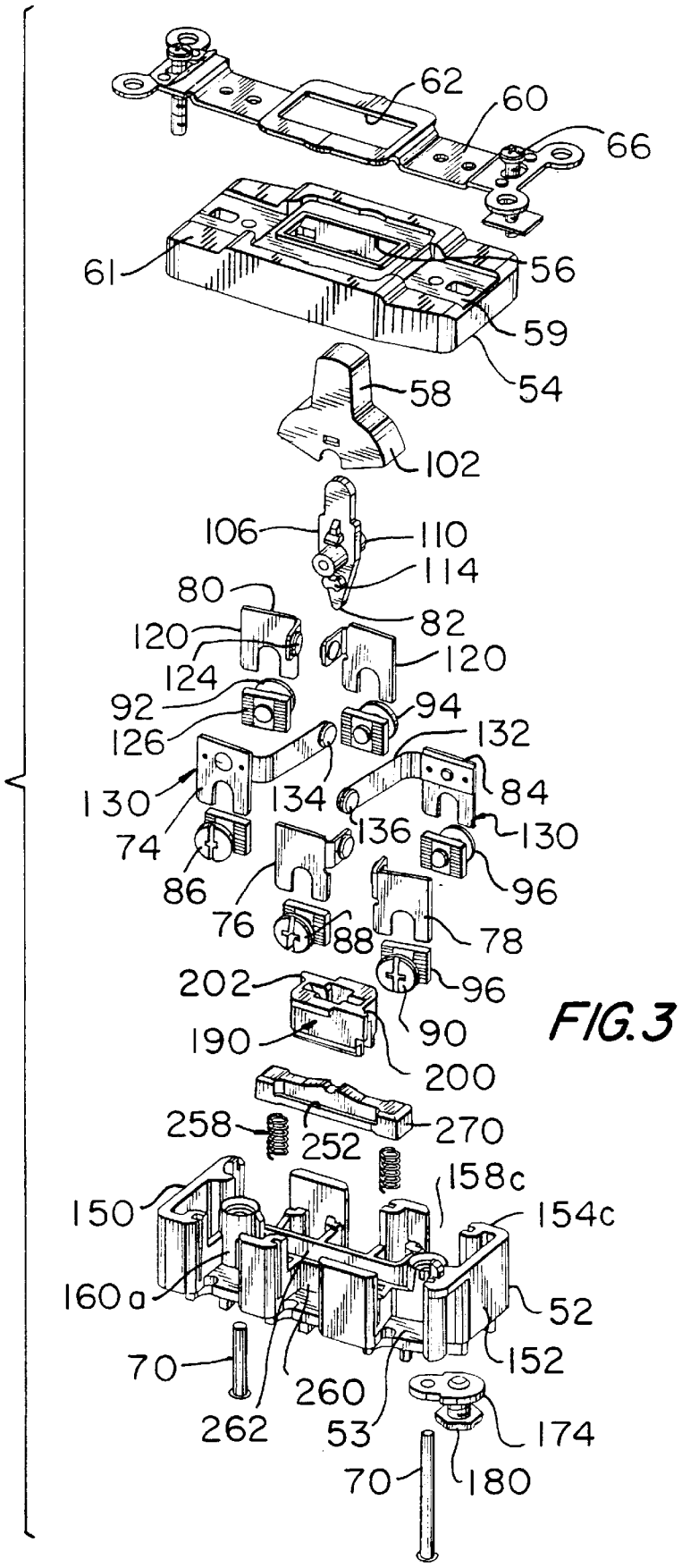
FIG. 3 is an exploded, perspective view of the switch of FIG. 1.
Figure 16:
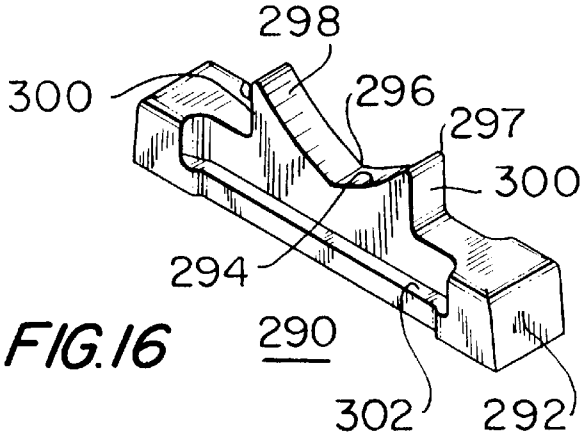
FIG. 16 is a top perspective view of yet another cam which may be employed with the switch of FIG. 1.
Figure 17:
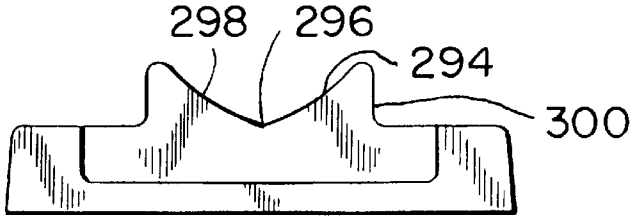
FIG. 17 is a side elevational view of the cam of FIG. 16.
Figure 19:
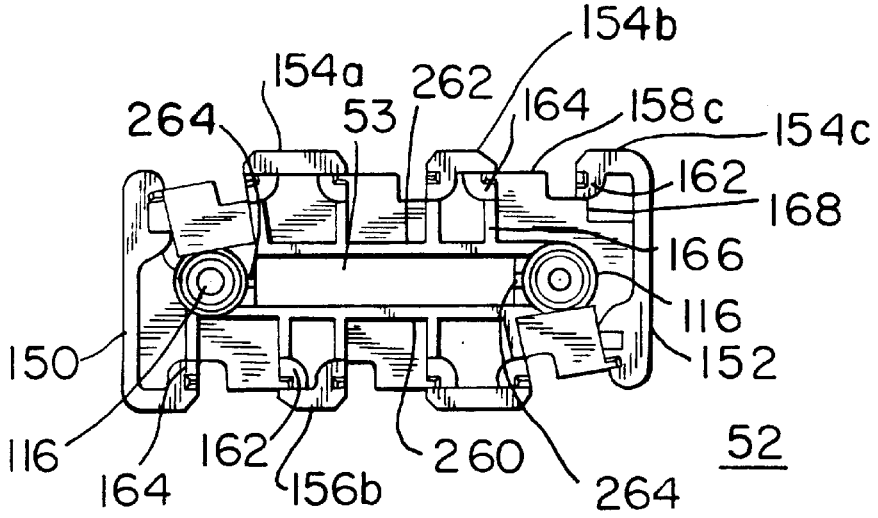
FIG. 19 is a top plan view of the housing of the switch of FIG. 1.
Figure 20:
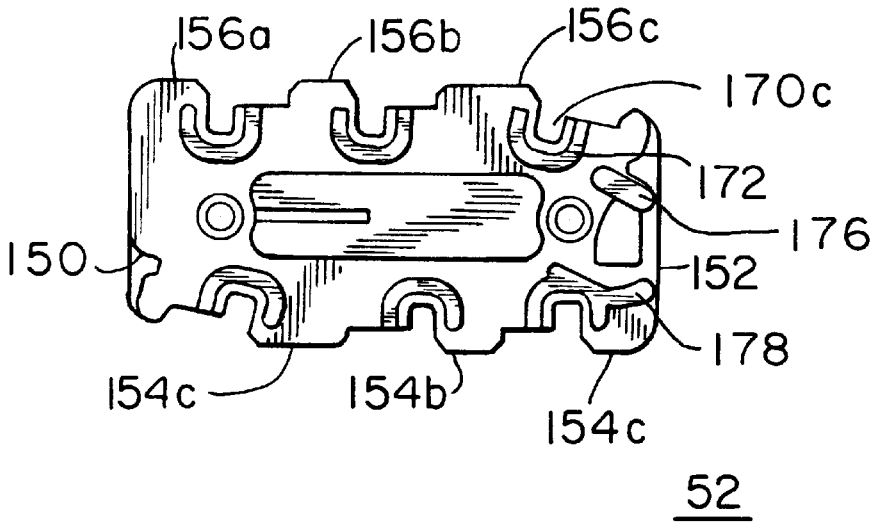
FIG. 20 is a bottom plan view of the housing of the switch of FIG. 1.

At times it is necessary to close a switch for a very short time and such a switch is generally referred to as a momentary switch. The toggle lever 58 is moved in either one of two opposite positions and when released the toggle lever 58 quickly returns to the center off position. Cam 290 permits the switch to act as a single or double pole, double throw momentary switch with center off. As shown in FIGS. 16 and 17 the cam surface has a deep central valley 296 which acts as the center off position. When the toggle lever 58 of FIG. 2 is moved to the left in the figure, the cam follower 108 traverses the inclined surface 294 far enough to close one set of movable and fixed contacts. However, the surface 296 is so long that cam follower 108 cannot get over crest 297 to reach surface 300 to reach a stable position. When toggle lever 58 is released, the springs 258 force the cam 290 upwardly returning cam follower 108 to the base of the valley 296. Pushing toggle lever 58 to the right in FIG. 2 causes the cam follower 108 to traverse surface 298 as long as toggle lever 58 is held in the rightmost position. This closes the second set of contacts which open when the toggle lever 58 is released and moves back to the center off position 296. Rails 302 on body 292 accept the slider 190.

Turning now to FIG. 29, there is shown a top plan view of a double pole, double throw switch in its center off position with the cap 54 and toggle means 57 removed. The slider 190 is centered and nose 202 acts upon the left resilient arm 132 to hold movable contacts 136, 134 away from fixed contacts 124 of contact plates 80 and 82, respectively. At the same time nose 200 acts upon right resilient arm 132 to hold movable 134, 136 away from fixed contacts 124 of contact plates 76 and 78, respectively. If nose 202 did not act upon the left resilient arm 132, the movable contact 134 would engage the fixed contact 124 of contact plate 82 due to the bias built into resilient arm 132. In a similar manner, the absence of nose 200 would permit movable contact 134 of the right resilient arm to engage fixed contact 124 of contact plate 76.

As the toggle lever 58 is moved from the center off position as shown in FIG. 2 to the left in such figure, the cam follower 108 starts to move out of valley 276 and slider actuators 114 engage the left walls of slot 208 to move slider 190 to the left on rails 280 of cam 270. The nose 202 engages the left resilient arm 132 to move movable contact 136 into engagement with fixed contact 124 of contact plate 80. At the same time the movement of nose 200 permits the right resilient arm 132 to move its movable contact 134 into engagement with fixed contact 124 of contact plate 76. The cam follower 108 moves out of valley 276 and onto the tapered shoulder 274 to establish a first stable state or one of the switches double throw positions. The further movement of toggle lever 58 is prevented by the engagement of the left stop surface 104 with the top of nose 202. The cam 270 which was depressed against the bias of springs 258 is now permitted to return to its original position holding the toggle lever 58 in its first throw position. A similar action takes place when toggle lever 58 is moved to the right in FIG. 2.

For a single pole, double throw switch, the left resilient arm 132 of contact support 130 and the contact supports 120 having contact plates 80 and 82 can be omitted. For a simple on/off switch the right resilient arm 132, the contact supports 120 for contact plates 82, 84 and 78 could be omitted.

While there have been shown and described and pointed out the fundamental novel features of the invention as applied to the preferred embodiments as are presently contemplated for carrying them out, it will be understood that various omissions and substitutions and changes of the form and details of the devices illustrated and in their operation may be made by those skilled in the art, without departing from the spirit of the invention.

I claim:

1. An electrical toggle switch comprising:

a) a switch body having an open first end, a closed second end and a chamber therebetween;

b) a cover plate having a top surface and a bottom surface with a central passage therethrough from said top surface to said bottom surface, said cover plate adapted to be placed over said switch body open first end to partially close said switch body open first end;

c) toggle means pivotally mounted within said chamber having a toggle lever at one end extending through said central passage for engagement by a user, a cam follower at a second end and a lever body therebetween, a pair of slider actuators on said lever body for driving a slider means, said toggle means movable between a first position and a second position and an intermediate position therebetween;

d) slider means mounted in said switch body cavity having a top surface and a bottom surface with an aperture extending from said top surface to said bottom surface to permit a portion of said lever body to extend therethrough to receive therein said pair of slider actuators, to move said slider means between a first and a second position, said slider means having a first end and a second end and shoulders adjacent said aperture to limit said toggle means pivotal movement, said slider means having two extensions extending below said bottom surface;

e) at least one fixed contact in said switch body chamber having a first terminal for connection to a first electrical conductor;

f) at least one resilient movable arm in said switch body chamber, said at least one resilient movable arm having a first end coupled to said switch body and a second end extending into said switch body chamber and having at least one movable contact at said movable arm second end; said at least one movable contact arm having a second terminal for connecting to a second electrical conductor, said at lest one movable arm adapted to be moved by said first end of said slider means as it is moved to said first position to cause said at least one movable contact to engage said at least one fixed contact to close an electrical circuit between said first and second electrical conductors and permit said at least one movable arm to move said at least one movable contact away from said at least one fixed contact to open the circuit between said first and second electrical conductors when said slider means is moved to said second position;

g) cam means having a contoured top surface formed as a first and second portion with an intermediate portion therebetween, said first portion describing a first position, said second portion describing a second position and said intermediate portion describing a third position and a bottom surface, said cam follower following the contour of said top surface to control the position of said slider means according to the position of said toggle lever by the engagement of said slider actuators with said slider means, a pair of rails to receive thereon said extensions of said slider means to permit movement of said means with respect to said cam means, and stops to limit such movement; and h) spring means in said switch body chamber and extending between said closed second end and said bottom surface of said cam means to bias said cam means top surface against said cam follower, said spring means comprising two spring members, one adjacent each end of said cam means.

2. An electrical toggle switch, as defined in claim 1, wherein said intermediate portion has a central peak extending into sloped shoulders in said first and second portions whereby said toggle lever can be placed in one of said first and second positions only.

3. An electrical toggle switch, as defined in claim 2, wherein:

a) said at least one fixed contact is two contacts, a first of said two fixed contacts connected to said first conductor and the second of said two fixed contacts is connected to a third conductor; and b) said at least one movable contact is two movable contacts;

c) whereby said second conductor can be coupled to said first conductor when said toggle lever is in a first position and to said third conductor when said toggle lever is in a second position.

4. An electrical toggle switch, as defined in claim 2, wherein:

a) said at least one fixed contact is two fixed contacts, a first of said two fixed contacts connected to said first conductor and the second of said two fixed contacts is connected to a third conductor; and b) said at least one resilient movable arm is two resilient movable arms and a first of said two resilient movable arms is connected to said second conductor and said second of said two resilient arms is connected to a fourth conductor;

c) whereby said second conductor is coupled to said first conductor and said fourth conductor is coupled to said third conductor when said toggle lever is in a first position.

5. An electrical toggle switch, as defined in claim 2, wherein:

a) said at least one fixed contact is four fixed contacts, a first of said four fixed contacts is connected to said first conductor, a second fixed contact is connected to a third conductor, a third fixed contact is connected to a fourth conductor and the fourth fixed contact is connected to a fifth conductor; and b) said at least one resilient movable arm is two resilient movable arms and said at least one movable contact is two movable contacts, said first of said two resilient movable arms connected to said second conductor and said second of said two resilient movable arms connected to a sixth conductor;

c) whereby said second conductor can be coupled to said first conductor and said sixth conductor can be coupled to said third conductor when said toggle lever is in a first position and said second conductor can be coupled to said fourth conductor and said sixth conductor coupled to said fifth conductor when said toggle lever is in a second position.

6. An electrical toggle switch, as defined in claim 1, wherein:

a) said intermediate portion of said cam means top surface has a central peak with a shallow generally U-shaped depression therein, the free ends of which extend into sloped shoulders in said first and second portions whereby said toggle lever can be placed in one of said first, second and intermediate positions.

7. An electrical toggle switch, as defined in claim 6, wherein:

a) said cam follower can be placed in said shallow depression when said toggle lever is in said intermediate position to prevent the engagement of said at least one movable contact with said associated at least one fixed contact.

8. An electrical toggle switch, as defined in claim 6, wherein:

a) said at least one fixed contact is two fixed contacts, a first of said two fixed contacts connected to said first conductor and the second of said two fixed contacts connected to a third conductor; and b) said at least one movable contact is two movable contacts;

c) whereby said second conductor can be coupled to said first conductor when said toggle lever is in a first position and can be coupled to said third conductor when said toggle lever is in a second position and not connected to either said first or third conductors when said toggle lever is in said intermediate position.

9. An electrical toggle switch, as defined in claim 6, wherein:

a) said at least one fixed contact is two fixed contacts, a first of said two fixed contacts connected to said first conductor and the second of said two fixed contacts connected to a third conductor; and b) said at least one resilient movable arm is two resilient movable arms and a first of said two resilient movable arms is connected to said second conductor and said second of said two resilient arms is connected to a fourth conductor;

c) whereby said second conductor is coupled to said first conductor and said fourth conductor is coupled to said third conductor when said toggle lever is in a first position.

10. An electrical toggle switch, as defined in claim 6, wherein:

a) said at least one fixed contact is four fixed contacts, a first of said four fixed contacts is connected to said first conductor, a second fixed contact is connected to a third conductor, a third fixed contact is connected to a fourth conductor and the fourth fixed contact is connected to a fifth conductor; and b) said at least one resilient movable arm is two resilient movable arms and said at least one movable contact is two movable contacts, said first of said two resilient movable arms connected to said second conductor and said second of said two resilient movable arms connected to a sixth conductor;

c) whereby said second conductor can be coupled to said first conductor and said sixth conductor can be coupled to said third conductor when said toggle lever is in a first position, said second conductor can be coupled to said fourth conductor and said sixth conductor coupled to said fifth conductor when said toggle lever is in a second position and said second and third conductors not connected to any other conductors when said toggle lever is in its intermediate position.

11. An electrical toggle switch, as defined in claim 1, wherein:

a) said intermediate portion of said, cam means top surface has a central peak with a deep generally V-shaped depression therein, the free ends of which extend to perpendicular side walls at the junctions of said intermediate portion with said first and second portions, said depression being of a depth to prevent said cam follower from exiting said depression to engage said first and second portions whereby said cam follower will move to the base of said V-shaped depression whenever said toggle means is released after having been moved towards either of said first position and said second position; and b) whereby the engagement of any of said contacts is momentary only as long as said toggle lever is operated.

12. An electrical toggle switch, as defined in claim 11, wherein:

a) said at least one fixed contact is two fixed contacts, a first of said two fixed contacts connected to said first conductor and a second of said two fixed contacts connected to a third conductor; and b) said at least one movable contacts is two movable contacts;

c) whereby said second conductor can be momentarily coupled to said first conductor when said toggle lever is moved towards a first position and can be momentarily coupled to said third conductor when said toggle lever is moved towards a second position.

13. An electrical toggle switch, as defined in claim 11, wherein:

a) said at least one fixed contact is two fixed contacts, a first of said two fixed contacts connected to said first conductor and the second of said two fixed contacts connected to a third conductor; and b) said at least one resilient movable arm is two resilient movable arms and a first of said two resilient movable arms is connected to said second conductor and the second of said two resilient arms is connected to a fourth conductor;

c) whereby said second conductor is momentarily coupled to said first conductor and said fourth conductor is momentarily coupled to said third conductor when said toggle lever is moved towards a first position.

14. An electrical toggle switch, as defined in claim 11, wherein:

a) said at least one fixed contact is four fixed contacts, a first of said four fixed contacts is connected to said first conductor, a second fixed contact is connected to a third conductor, a third fixed contact is connected to a fourth conductor and the fourth fixed contact is connected to a fifth conductor; and b) said at least one resilient movable arm is two resilient movable arms and said at least one movable contact is two movable contacts, said first of said two resilient movable arms connected to said second conductor and said second of said two resilient movable arms connected to a sixth conductor;

c) whereby said second conductor is momentarily coupled to said first conductor and said sixth conductor is momentarily coupled to said third conductor when said toggle lever is moved towards a first position, said second conductor is momentarily coupled to said fourth conductor and said sixth conductor is momentarily coupled to said fifth conductor when said toggle lever is moved towards a second position.

* * * * *